US010384751B2

(12) United States Patent
Agapiades

(10) Patent No.: US 10,384,751 B2
(45) Date of Patent: Aug. 20, 2019

(54) INFLATABLE PERSONAL BODYWEAR FLOTATION DEVICE

(71) Applicant: Athanasios Agapiades, Gredley, CA (US)

(72) Inventor: Athanasios Agapiades, Gredley, CA (US)

( * ) Notice: Subject to any disclaimer, the term of this patent is extended or adjusted under 35 U.S.C. 154(b) by 0 days.

(21) Appl. No.: 15/311,402

(22) PCT Filed: Jun. 19, 2015

(86) PCT No.: PCT/US2015/036667

§ 371 (c)(1),
(2) Date: Nov. 15, 2016

(87) PCT Pub. No.: WO2015/196059

PCT Pub. Date: Dec. 23, 2015

(65) Prior Publication Data

US 2017/0073052 A1 Mar. 16, 2017

Related U.S. Application Data

(60) Provisional application No. 62/014,580, filed on Jun. 19, 2014.

(51) Int. Cl.

| | |
|---|---|
| ***B63C 9/15*** | (2006.01) |
| ***B63C 9/19*** | (2006.01) |
| *B63C 9/13* | (2006.01) |
| *B63C 9/20* | (2006.01) |

(52) U.S. Cl.
CPC ..... *B63C 9/19* (2013.01); *B63C 9/155* (2013.01); *B63C 9/20* (2013.01); *B63C 2009/131* (2013.01); *B63C 2009/133* (2013.01)

(58) Field of Classification Search
CPC ..... B63C 9/19; B63C 9/155
See application file for complete search history.

(56) References Cited

U.S. PATENT DOCUMENTS

| | | | | | |
|---|---|---|---|---|---|
| 2,722,020 | A | * | 11/1955 | Gazelle | A41D 13/0012 2/93 |
| 4,629,436 | A | * | 12/1986 | Stewart | B63C 9/155 222/5 |
| 724,279 | A | * | 11/1988 | Goldstein | A63H 33/00 441/100 |
| 4,781,645 | A | * | 11/1988 | Kato | A63H 33/00 441/100 |

(Continued)

*Primary Examiner* — Stephen P Avila
(74) *Attorney, Agent, or Firm* — Flener IP & Business Law; Zareefa B. Flener

(57) ABSTRACT

A persona! flotation device for a user comprises a bodywear member, as well as a container containing buoyant gas and an actuation assembly, both of which are mounted to the bodywear member. The bodywear member is to be worn to by the user such as on the wrist or the neck. The actuation assembly is in operative communication with the container containing buoyant gas for selectively being actuated so as to provide fluid communication between the container containing buoyant gas and the inflatable member. Actuation of the actuation assembly provides for releasing the buoyant gas into the inflatable member causing the inflatable member to inflate and provide buoyancy to the persona! flotation device.

11 Claims, 14 Drawing Sheets

(56) References Cited

U.S. PATENT DOCUMENTS

| | | | | |
|---|---|---|---|---|
| 4,857,029 | A * | 8/1989 | Dierick | A63H 37/00 206/216 |
| 5,954,556 | A * | 9/1999 | Powers | B63C 9/155 441/108 |
| 6,700,034 | B1 * | 3/2004 | Lindsay | A61F 13/4704 604/367 |
| 2008/0146105 | A1 * | 6/2008 | Haselsteiner | B63C 9/155 441/123 |
| 2009/0318042 | A1 * | 12/2009 | Huang | B63C 9/155 441/122 |
| 2012/0034831 | A1 * | 2/2012 | Andrea | B63C 9/155 441/93 |
| 2014/0051309 | A1 * | 2/2014 | McCarthy | B63C 9/081 441/96 |

* cited by examiner

110'
118'
116'

110'
112
114'

118'

110''
121''
120''
126''
114''
112''

110''
121''
120''
118''
124''
114''

118''
120''
116''
12''
22''

122''
124''
126''

110'''
114'''
120'''
12'''

110'''
130'''
128'''
116'''
122'''
CO2
126'''

130'''
118'''
124'''
110'''
116'''
112'''

130'''
118'''
110'''
116'''
112'''

INFLATABLE PERSONAL BODYWEAR FLOTATION DEVICE

CROSS-REFERENCE TO RELATED APPLICATIONS

This application claims priority on U.S. Provisional Patent Application No. 62/014,580 filed on Jun. 19, 2014 and incorporated herein in its entirety.

TECHNICAL FIELD

This the present disclosure relates to flotation devices. More specifically, but not exclusively, the present disclosure relates to an inflatable personal bodywear flotation device. More particularly, but still not exclusively, the present disclosure relates an inflatable personal bodywear flotation device for the wrist or the neck.

BACKGROUND

Personal flotation devices are well known lifejackets, life preservers, Mae West, life vests, life savers, cork jackets, life belts, flotation suits, and other similar apparatuses. These devices assist the wearer in order to keep them afloat with their airway (mouth and nose) of their head away from water.

Many of these devices are often large and cumbersome and not worn by users. Furthermore, many of these devices are not inflatable and deflatable and hence, can not be used by swimmers who do not require floatation assistance during swimming but prefer having such assistance in an emergency situation only.

OBJECTS

It is an object of the disclosure to provide inflatable personal bodywear flotation device.

It is an object of the disclosure is to provide an inflatable personal bodywear flotation device for the wrist.

It is an object of the disclosure is to provide an inflatable personal bodywear flotation device for the neck.

It is an object of the disclosure to provide inflatable personal bodywear flotation kit.

It is an object of the disclosure is to provide an inflatable personal bodywear flotation kit for the wrist.

It is an object of the disclosure is to provide an inflatable personal bodywear flotation kit for the neck.

SUMMARY

In accordance with an aspect of the present disclosure, there is provided a personal flotation device for a user comprising: a bodywear member to be worn to by the user; an inflatable member mounted to the bodywear member; a container containing buoyant gas mounted to the bodywear member; and an actuation assembly connected to the bodywear member and in operative communication with the container containing buoyant gas for selectively being actuated so as to provide fluid communication between the container containing buoyant gas and the inflatable member, wherein actuation of the actuation assembly provides for releasing the buoyant gas into the inflatable member causing the inflatable member to inflate and provide buoyancy to the personal flotation device.

In accordance with an aspect of the present disclosure, there is provided a personal flotation kit for a user comprising: a personal flotation device comprising a bodywear member to be worn to by the user and an actuation assembly connected to the bodywear member; at least one inflatable member for being mounted to the personal flotation device; at least one a container containing buoyant gas for being mounted to the personal flotation device, wherein the actuation assembly is in operative communication with the container containing buoyant gas for selectively being actuated so as to provide fluid communication between the container containing buoyant gas and the inflatable member, wherein actuation of the actuation assembly provides for releasing the buoyant gas into the inflatable member causing the inflatable member to inflate and provide buoyancy to the device.

In an embodiment, the bodywear member is a wristband. bodywear member is mounted to the neck of a user.

In an embodiment, an inflatable member container contains the inflatable member and is mounted to the bodywear member, wherein when the inflatable member inflates it moves outwardly of the inflatable member container. In an embodiment, the inflatable member container comprises an openable closure.

In an embodiment, the container containing buoyant gas is in fluid communication with the inflatable member via a pipe.

In an embodiment, the actuation assembly provides for piercing the container containing buoyant gas for releasing the buoyant gas therein into the inflatable member.

In an embodiment, a housing is mounted to the bodyear member for housing the container containing buoyant gas, wherein the actuation assembly is in operative communication with the housing. In an embodiment, the actuation assembly comprises an actuation lever pivotally mounted to the housing in operative communication with a plunger for actuating the plunger to pierce the container containing buoyant gas. In an embodiment, the housing further comprises a pipe in fluid communication with the inflatable member so as to allow the buoyant gas to flow from the container containing buoyant gas to the inflatable member.

In an embodiment, the inflatable member comprises a balloon.

In an embodiment, there is provided an additional device selected from the group consisting of a GPS, a communication device, a thermometer, a watch, a compass, and any combination thereof.

In an embodiment, the buoyant gas comprises CO2.

In an embodiment, the container containing buoyant gas is deformable and contains breakable capsules for producing the buoyant gas. In an embodiment, the actuation assembly provides for selectively applying sufficient pressure on the container containing buoyant gas so as to break the capsules thereby producing buoyant gas.

Other objects, advantages and features of the present disclosure will become more apparent upon reading of the following non-restrictive description of illustrative embodiments thereof, given by way of example only with reference to the accompanying drawings.

DETAILED DESCRIPTION

Figure 1:
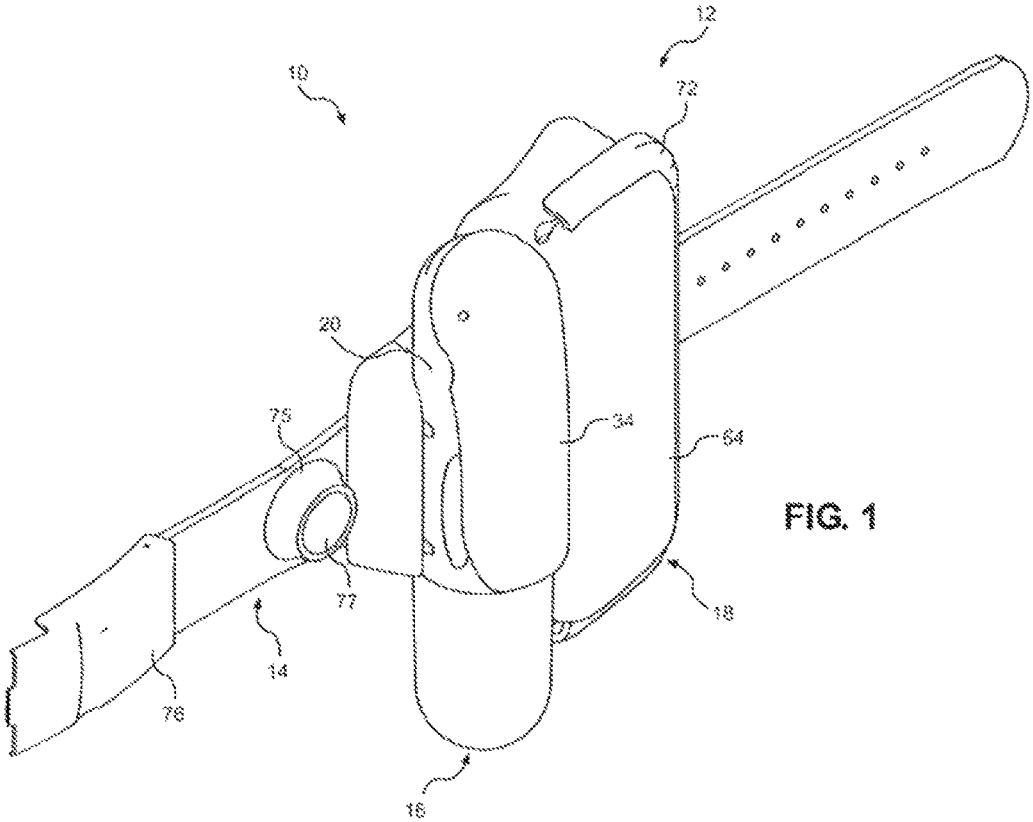
FIG. 1 is a perspective view of an inflatable bodywear flotation device in accordance with a non-restrictive illustrative embodiment of the present disclosure.
Figure 2:
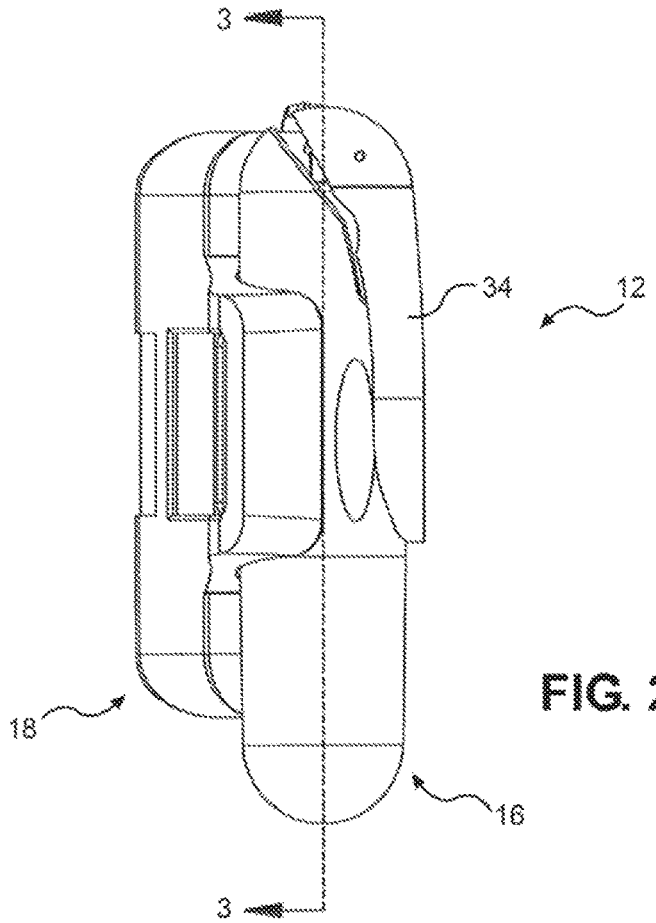
FIG. 2 is a lateral side view of the main body of the device of FIG. 1.

Generally stated, there is provided a personal flotation device as a kit using such a device for a user and comprising a bodywear member, as well as a container containing buoyant gas and an actuation assembly, both of which are mounted to the bodywear member. The bodywear member is to be worn to by the user such as on the wrist or the neck. The actuation assembly is in operative communication with the container containing buoyant gas for selectively being actuated so as to provide fluid communication between the container containing buoyant gas and the inflatable member. Actuation of the actuation assembly provides for releasing the buoyant gas into the inflatable member causing the inflatable member to inflate and provide buoyancy to the personal flotation device.

FIGS. 1 to 10 show a personal flotation device 10 in accordance with a non-restrictive illustrated embodiment of the disclosure.

The personal flotation device 10 is shown including a main body 12 and a bodywear member in the form of a wristband 14 mounted thereto. The main body 12 includes a cylinder assembly 16 connected to an inflatable member assembly 18.

With reference to FIGS. 3, 5, 7 and 8, the cylinder assembly 16 includes a tubular housing 20 defining a space 22 for housing a cylinder container 24 containing a buoyant gas (such as CO2 for example). The cylinder 24 can be removed from the housing 20 by removing a cap 26 which threadedly mounted to the bottom end of the tubular housing 20.

Figure 8:
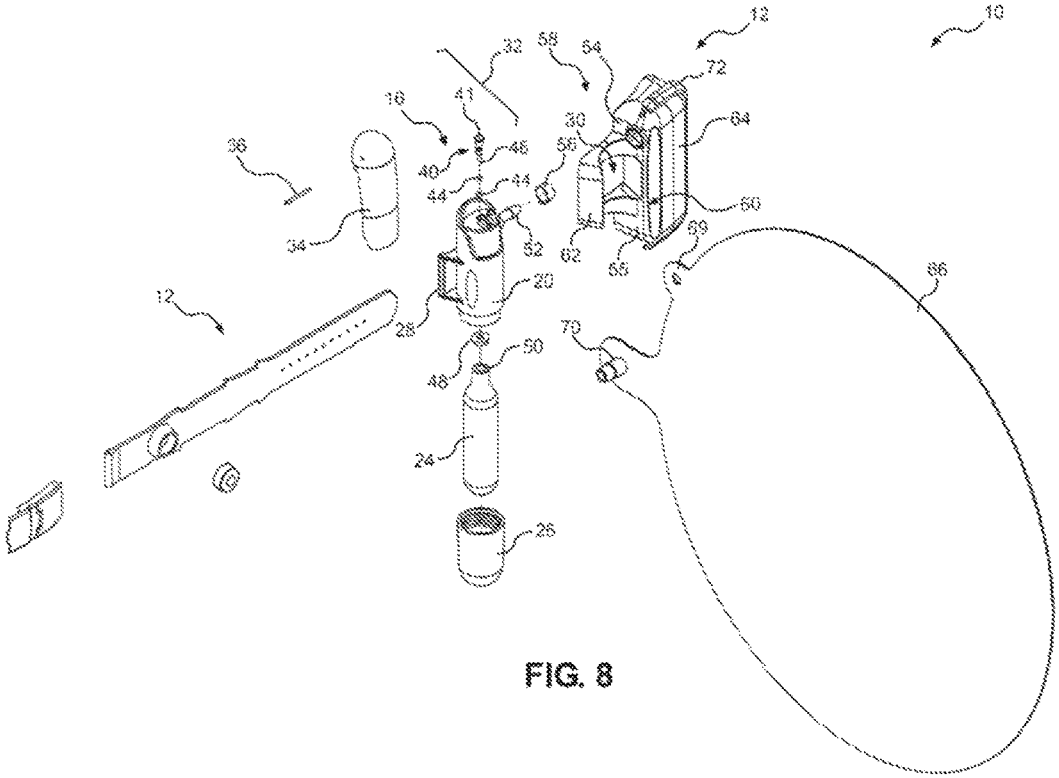
FIG. 8 is an exploded view of the device of FIG. 9.

With reference to FIG. 8, the cylinder assembly 16 includes a base portion 28 that is inserted in a corresponding cavity 30 formed by the inflatable member assembly 18 thereby connecting assemblies 16 and 18 in order to form the main body 12.

With particular reference to FIGS. 3, 5, 7 and 8, the cylinder assembly 16 includes an actuation assembly 32 which includes an actuation lever 34 pivotally mounted to the top of housing 20 via dowel pin 36.

Figure 7:
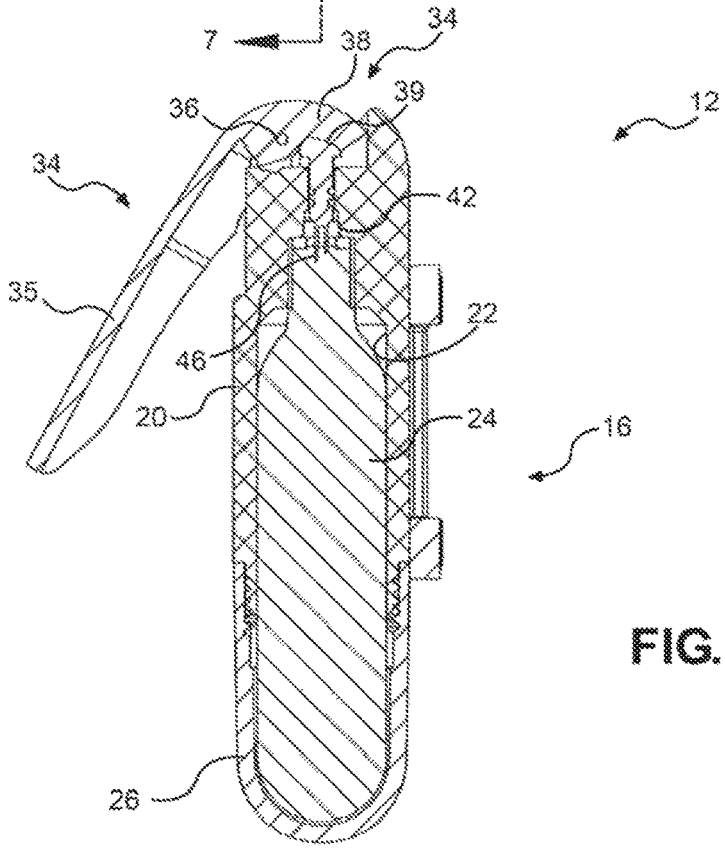
FIG. 7 is a sectional view of FIG. 6, taken along line 7-7 thereof.

The actuation lever 34 comprises a lever body 35 downstream the pivot connection at pin 36 and a push body 38 upstream pin 36 when moved as shown in FIG. 7 for example. The push body 38 defines an inner recess 39 for receiving a top end 41 of a plunger 40 movably positioned within a longitudinal tunnel opening 42 formed within the top area of the housing 20. The plunger 40 is held in place by o-rings 44 positioned within the tunnel. The plunger 40 is pushed downwardly by the push body 38 as in FIG. 7. The plunger 40 defines piercing point 46 at its bottom end that is moved through a gasket 48 positioned in the tunnel 42 to pierce the top end 50 of the cylinder container 24.

As shown in FIG. 8, the top area of the housing 20 includes a pipe 52 that is inserted in a complementary aperture 54 formed in a lateral wall 55 of by the inflatable assembly 16. The pipe 52 is secured to the aperture 54 via a clamp 56. As better shown in FIG. 3, the pipe is in fluid communication with the bottom section of the tunnel opening 42 above the top end 50 of the cylinder container 24.

As such, when the cylinder container 24 is pierced buoyant gas which is under high pressure within the cylinder container 24 flows outwardly therefrom and directly into the bottom section of tunnel 42 to enter the pipe 52 and to flow towards the inflatable member assembly 18.

With particular reference to FIG. 8, the inflatable member assembly 18 includes a manifold portion 58 including a main portion 60 defining the wall 55 and aperture 54 as well as an extension 62 which defines the open cavity 30. An inflatable member container or pouch 64 is connected to the main portion 60 and contains therein an inflatable member 66 in the form of a balloon for example.

Figure 3:
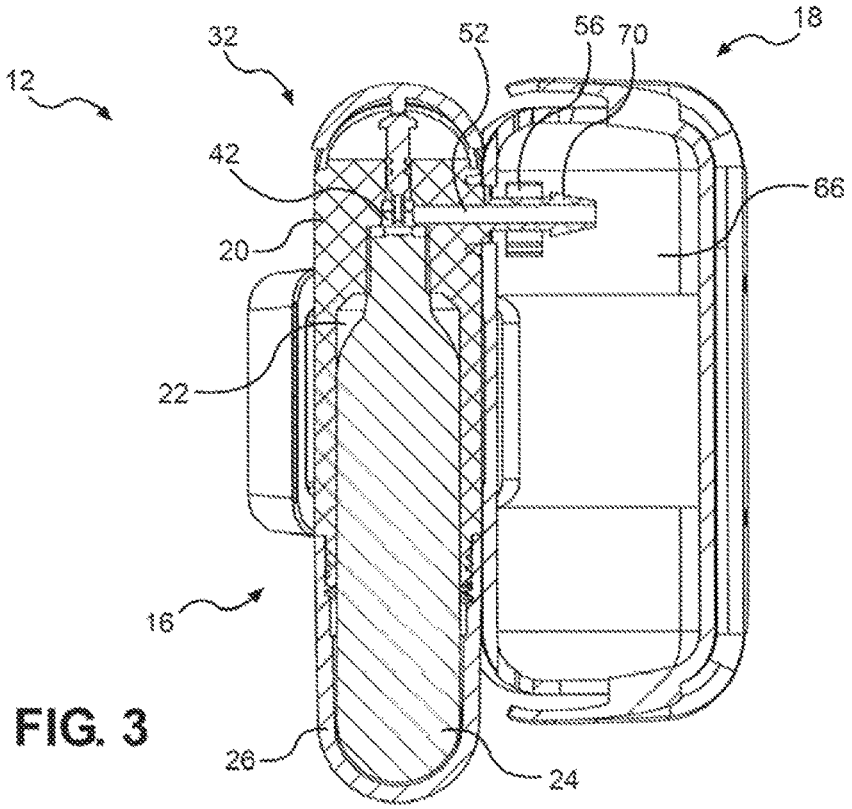
FIG. 3 is a sectional view of FIG. 2, taken along line 3-3 thereof.
Figure 4:
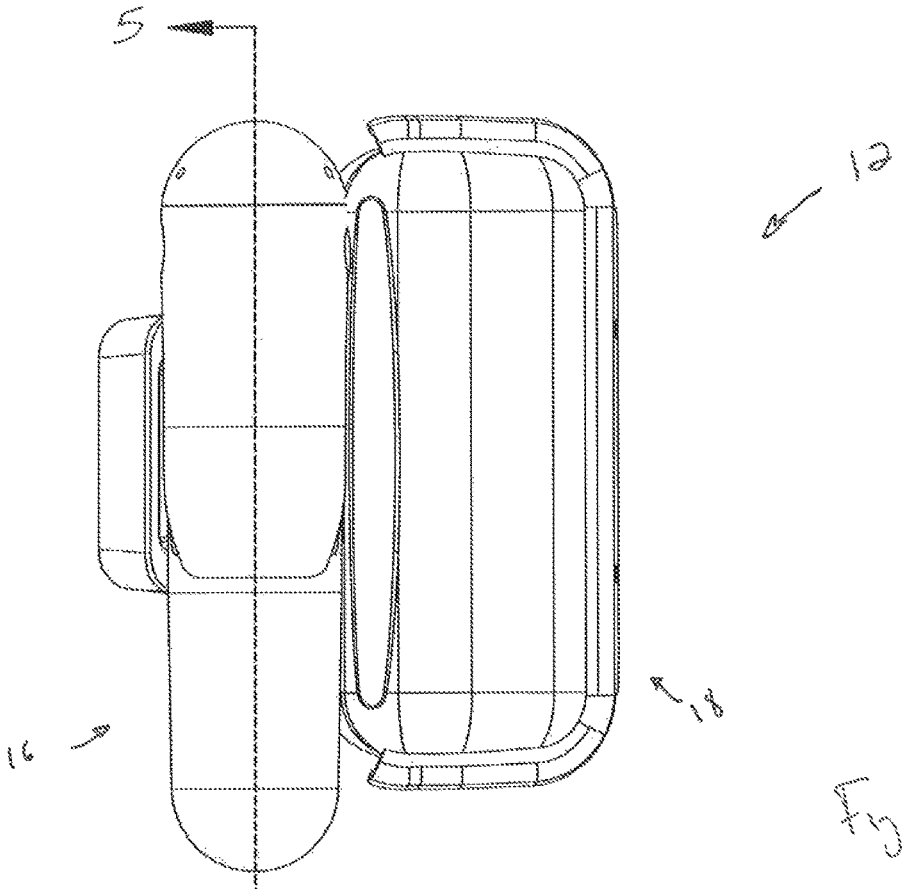
FIG. 4 is top view of the main body of the device of FIG. 1.
Figure 5:
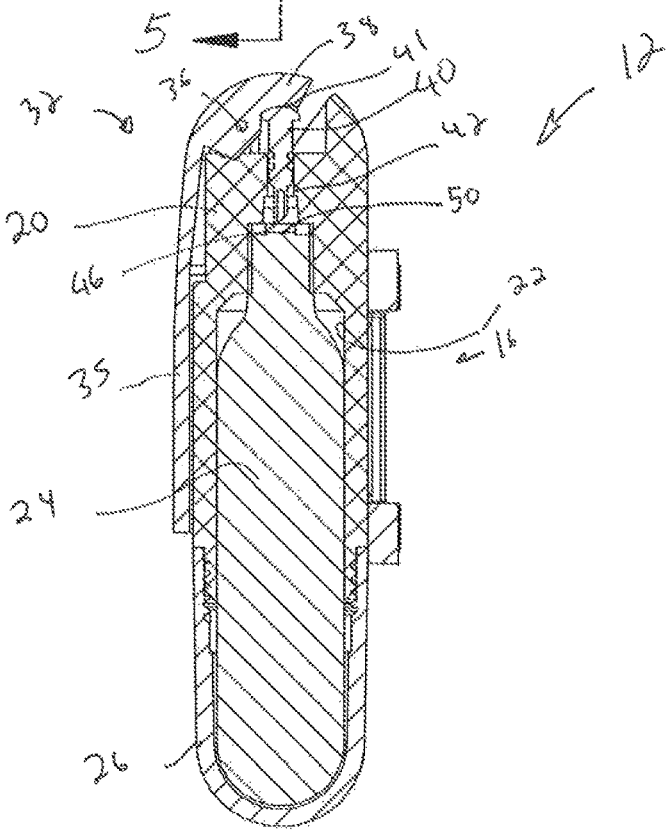
FIG. 5 is a sectional view of FIG. 4, taken along line 5-5 thereof.
Figure 6:
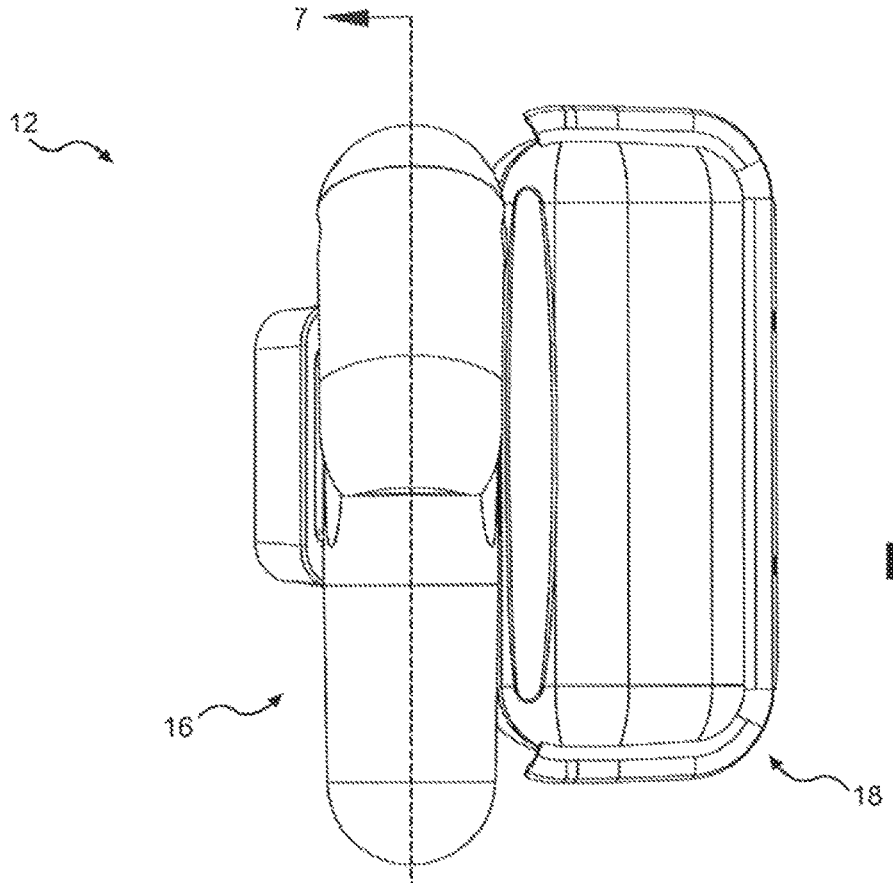
FIG. 6 is another top view of the main body of the device of FIG. 1.

The inflatable member 66 includes an extension 68 with a pipe element 70 which connects to pipe 52 and clamp 56 for allowing buoyant gas to flow therein during actuation (see FIG. 3).

The pouch 64 may include a supporting element 72. During actuation, as the inflatable member 66 inflates is extends outwardly of the pouch 64. The inflatable member 66 also includes an additional extension 69 for receiving a whistle or other element (not shown).

With respect to FIGS. 1 and 8, the device wristband 14 of device 10 which is positioned through the opening of the base portion 28 and the cavity 30 to be mounted to the wrist 74 (see FIGS. 9*a*-9*c*) of a user and secured thereto via a band clasp 76. The wristband 14 includes a socket 75 for receiving an additional device 77 such as GPS element, a thermometer and the like.

Figure 9A:
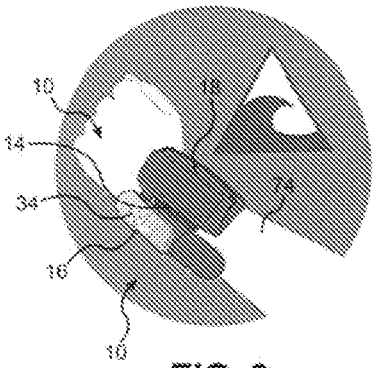
FIGS. 9*a*, 9*b* and 9*c* are respective schematic perspective views of the device of FIG. 1 in an operation from a non-inflated position to a fully inflated position, in accordance with a non-restrictive illustrative embodiment of the present disclosure.
Figure 9B:
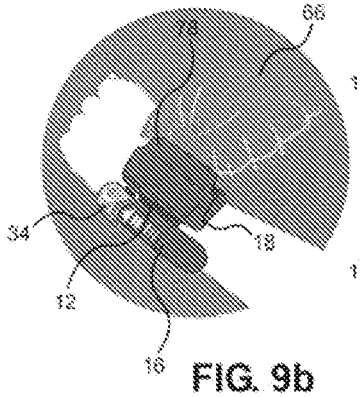
Figure 9C:
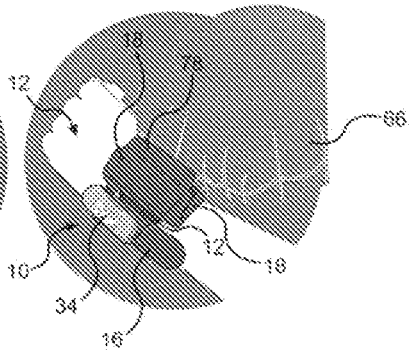

FIGS. 9*a*, 9*b* and 9*c*, show the device 10 in operation. The device is mounted on the wrist 74 of a swimmer (as shown in FIG. 9*a*). When the swimmer recognizes a danger, they lift the actuation lever 36 (as shown in FIG. 9*b*) which causes the release of buoyant gas into the inflatable member 64 causing it to inflate until it is completely inflated as shown in FIG. 9*c*, thereby assisting the user to float.

The pouch 64 in FIGS. 1 to 9*a*-9*c*, is shown having closure in the form of flaps 78 which are in closed position (as shown in FIGS. 1-9*a*) and are pushed opened (as shown in FIGS. 9*b* and 9*c*) when the inflatable member 64 inflates. The flaps 78 can be kept closed by snap buttons, magnates and the like.

Figure 10:
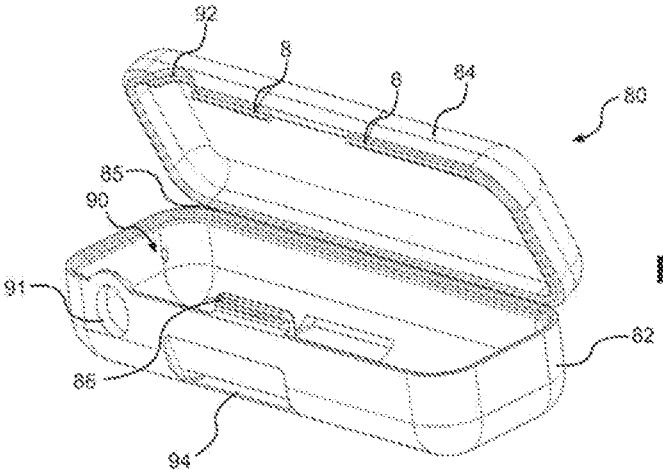
FIG. 10 is a perspective view of another inflatable member container that can be used in the device of FIG. 1, in accordance with a non-restrictive illustrative embodiment of the present disclosure.

FIG. 10 shows an inflatable member container 80 in accordance with another embodiment of the present disclosure. The container includes a main portion 82 with a closure in the form of a door 84 pivotally mounted thereto at edge 85. The main portion 82 and the door have mutually engaging snapping elements 86 and 88 respectively for being snap fitted and together when the container is closed 80 in order to house in the area 90 defined therein an inflatable member. The main portion includes an aperture and 91 and the door a complementary recess 92 in order to allow passage of a pipe for providing fluid communication between a buoyant gas container and the inflatable member. The main portion 82 also includes a back wall opening 94 for allowing passage of a wristband.

In other embodiments described below, the personal flotation device is shown as an inflatable wristband device 110 in FIGS. 11-12, device 110' in FIGS. 13*a*-13*c*, device 110" in FIGS. 4*a*-4*d*, device 110''' in FIGS. 5*a*-5*d*, device 210 in FIGS. 16*a*-16*e* and as an inflatable neckwear flotation device 1110 in FIGS. 17-111.

Figure 11:
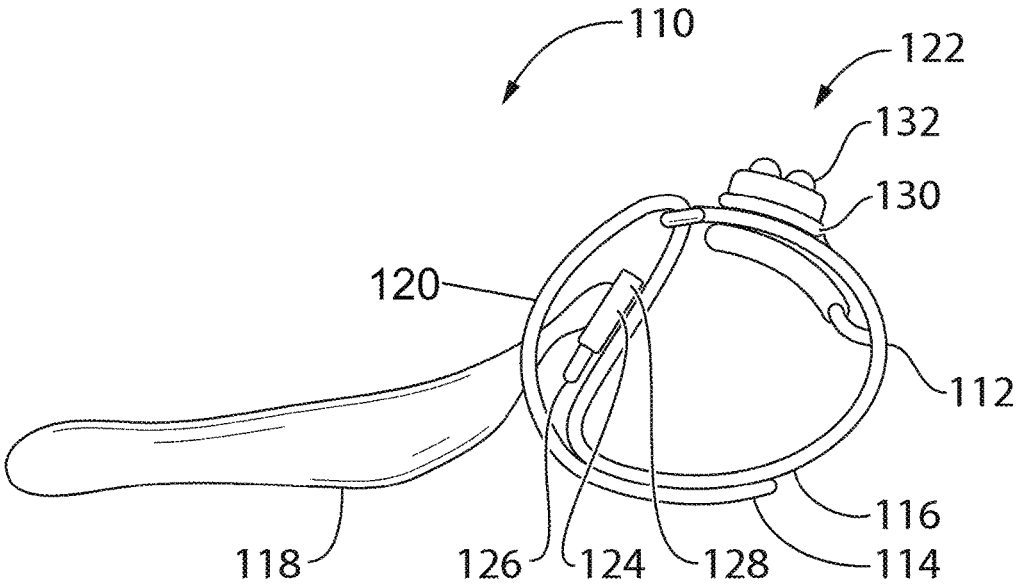
FIG. 11 is a perspective view of an inflatable wristband flotation device in ta non-inflated position in accordance with a non-restrictive illustrative embodiment of the present disclosure.
Figure 12:
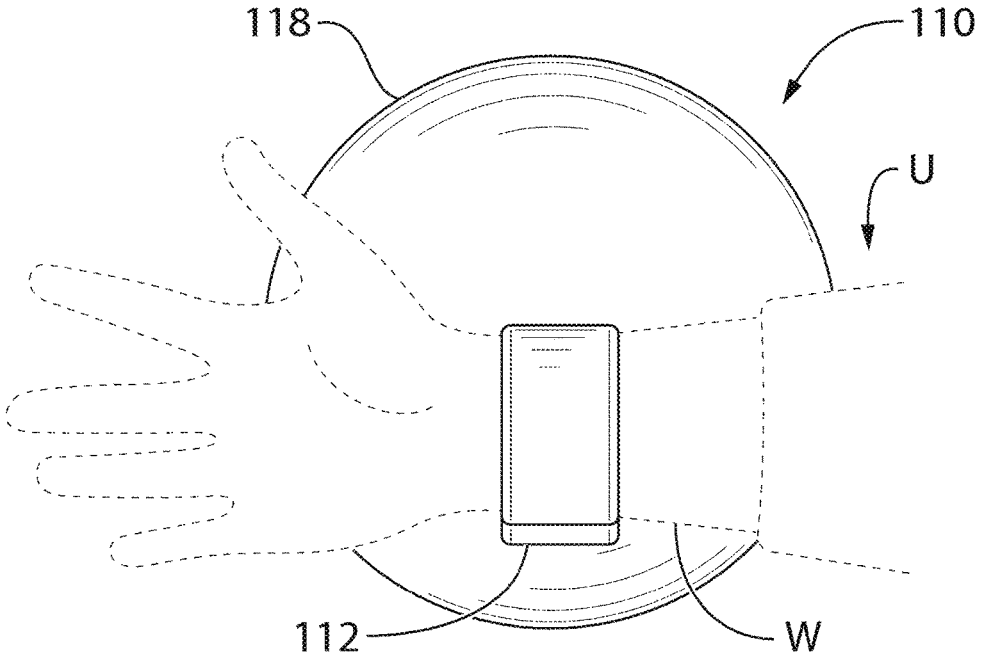
FIG. 12 is a perspective view of the inflatable wristband flotation device of FIG. 1 worn by a user and being in the inflated position in accordance with a non-restrictive illustrative embodiment of the present disclosure.

FIGS. 11 and 12 show the inflatable wristband device 110 comprising a wrist band 112 for being mounted to the wrist w of a user U. The wrist band 112 includes connecting ends 114 and 116 which have interconnecting elements mounting the band 112 around the wrist of the user U.

An inflatable member 118 is mounted to a portion 120 of the wrist band 12. The portion 120 includes an opening (now shown).

An actuator assembly 122 is connected to the wrist band 112 and to the inflatable member 118. The assembly includes a container in the form of a capsule 124 containing a buoyant gas. The capsule 124 is a tubular member having one end 126 mounted to portion 120 of the wrist band and another end 28 mounted to portion 30 of the wrist band. The capsule 124 extending through the opening 120 and is being connected a sealed opening (area 132) of the inflatable member 118.

An actuation lever 134 is mounted at portion 130 of the wrist band 112 for actuating a piercing element 136 for piercing the capsule 124 so as to release the buoyant gas therefrom into the inflatable member 118 thereby inflating the inflatable member 118 as shown in FIG. 12, thus provide buoyancy to the device 110.

Figures 13A, 13B, 13C, 14A, 14B, 14C, 14D:
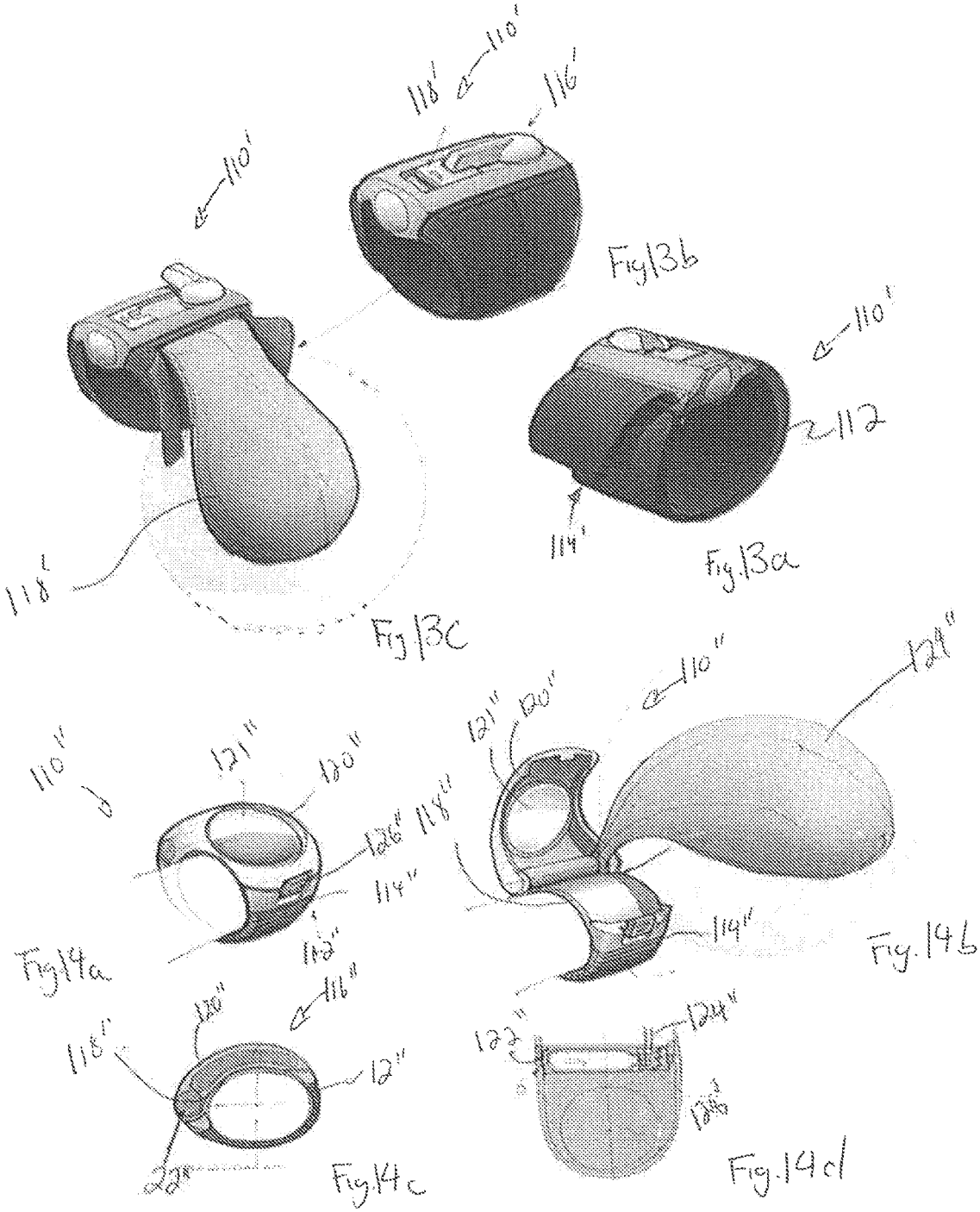
FIG. 13*a* is a perspective top, rear and side view of an inflatable wristband flotation device in a non-inflated position in accordance with another non-restrictive illustrative embodiment of the present disclosure.
FIG. 13*b* is a perspective top, rear and opposite side view of the device of FIG. 13*a* in the non-inflated position.
FIG. 13*c* is a perspective top, rear and opposite side view of the device of FIG. 13*a* in the inflated position.
FIG. 14*a* is perspective top, rear and side view of an inflatable wristband flotation device in a non-inflated position in accordance with a further non-restrictive illustrative embodiment of the present disclosure.
FIG. 14*b* is perspective top, rear and side view of the device of FIG. 14*a* in an inflated position.
FIG. 14*c* is a lateral side view of the device of FIG. 14*a* in a non-inflated position.
FIG. 14*d* is a section view of the device of FIG. 14*c;*
Figures 15A, 15B, 15C, 15D:
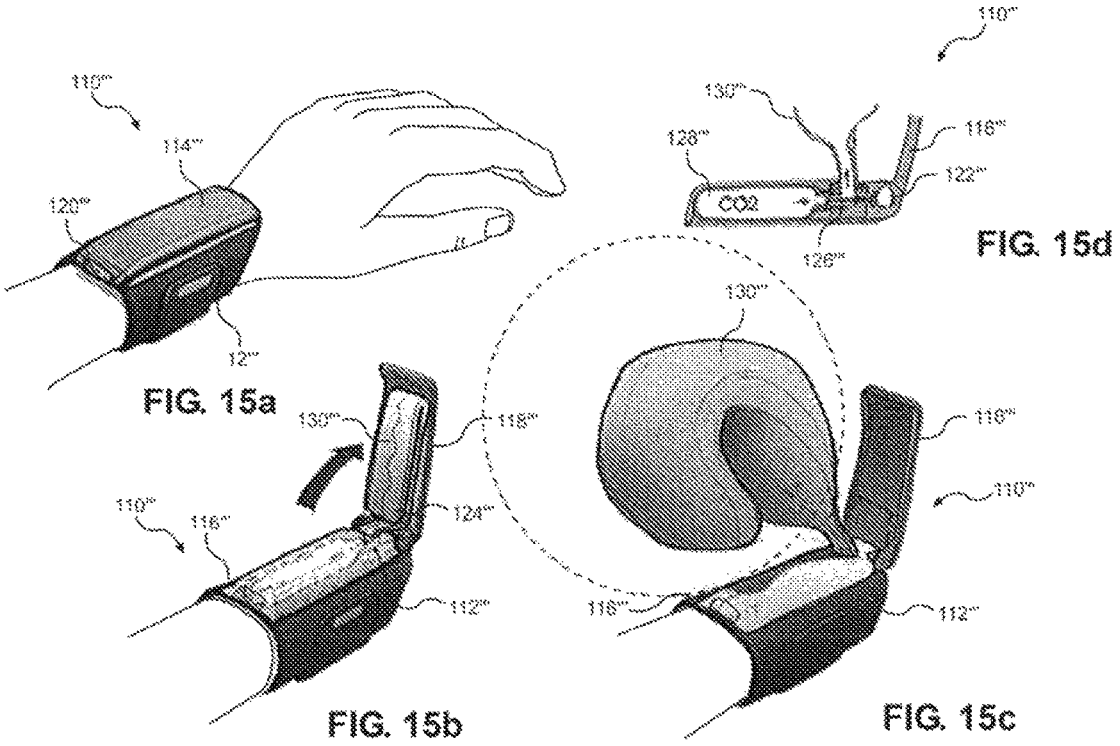
FIG. 15*a* is perspective top, rear and side view of an inflatable wristband flotation device in a closed and non-inflated position in accordance with yet another non-restrictive illustrative embodiment of the present disclosure
FIG. 15*b* is perspective top, rear and side view of the device of FIG. 15*a* in an open and non-inflated position.
FIG. 15*c* is perspective top, rear and side view of the device of FIG. 15*a* in an open and inflated position.
FIG. 15*d* is a side schematic sectional view of the device of FIG. 15*a* in an open and inflated position.

FIG. 13*a*-13*c* show the inflatable wristband device 10' comprising a wrist band or strap 112' with adjustable ends 114' such as a fabric hook and loop fastener for adjustable mounting to the wrist of a user. The device 110' includes an actuation assembly having a rotatable latch 116' acting on a tab 118' that is pushes forward to puncture the capsule containing a buoyant gas (such as CO2) and thereby release the gas into the inflatable member 120' such as a balloon thereby providing buoyancy to the device 110'.

FIGS. 14*a*-14*d* show the inflatable wristband device 110" comprising a wrist band 112" having a bottom cushioned elastic portion 114" connected to a top part 116" comprising a top base portion 118" that is contiguous with the portion 114". A top door 120" including a window 121" is hingendly connected at a spring loaded hinge 122" to the top base portion 118" for containing therebetween an inflatable member 124". An actuation assembly includes a push tab 126" which releases the door 120" opening it and acting on a ramp and pin assembly 128" which punctures the capsule 130" housed in pivot section 132" in the hinge 122' to release the buoyant gas therein into the inflatable member 124" so as to inflate it thereby providing buoyancy to the device 110".

FIGS. 15*a*-15*d* show the inflatable wristband device 110''' comprising a wrist band or strap 112''' that is adjustable. A housing 114''' is mounted to the strap 112''' and includes a base 116''' and a door 118''' hingedly mounted thereto. A push tab 120''' provides the user with releasing the door 118''' causing it to open and actuate the actuation assembly which includes a cam 122''' at the pivot 124''' of the door 118''' with respect to the base 116'''. The cam 120''' acts on a pin 126''' which punctures capsule 128''' housed within the housing 114''' in order to release a buoyant gas therein into the inflatable member 130''' mounted to the housing 114''' thereby inflating the member 130''' and providing buoyancy to the device 110'''.

Figure 16A:
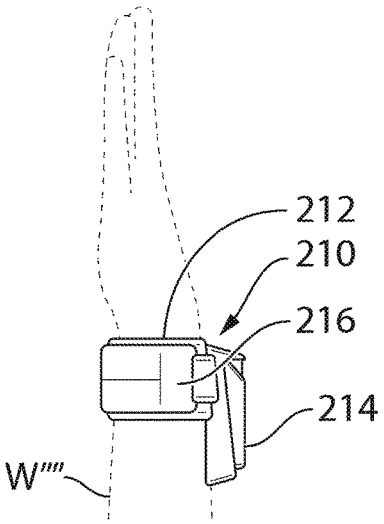
FIG. 16*a* is a lateral side view an inflatable wristband flotation device mounted to the wrist of a user in a non-inflated position in accordance with a further non-restrictive illustrative embodiment of the present disclosure.
Figure 16B:
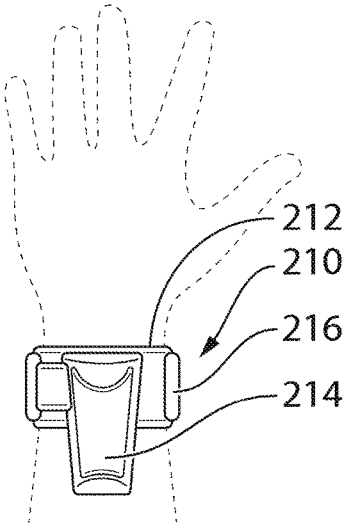
FIG. 16*b* is top view of the device of FIG. 16*a;*
Figure 16C:
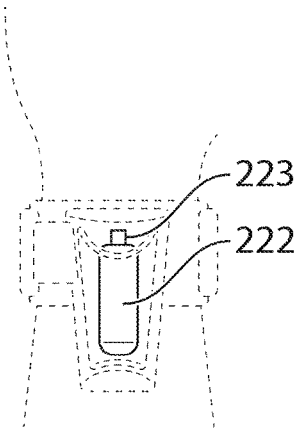
FIG. 16*c* is a top partially transparent view of the device of FIG. 16*a;*
Figure 16D:
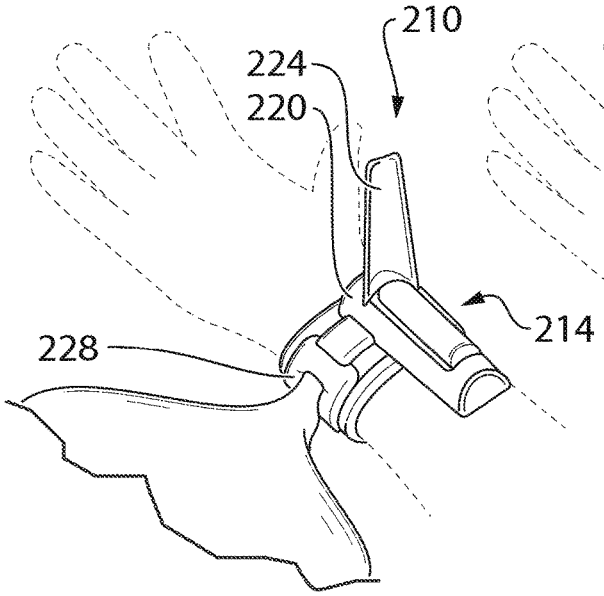
FIG. 16*d* is a perspective, rear and side view of the device of FIG. 16*a* in an inflated position.
Figure 16E:
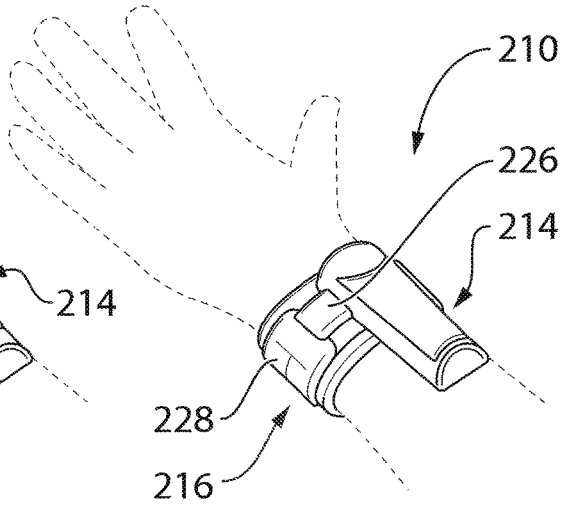
FIG. 16*e* is a top, rear and side view of the device of FIG. 16*a* in an inflated position.

FIGS. 16*a*-16*d* show an inflatable wristband device 210 mounted on the wrist W'''' of a user comprising a wrist band 212 with a main body assembly 214 mounted thereto. The main body 214 includes a top body portion 216 and a bottom body portion 218. The top body portion 218 comprises a housing 220 for housing a cylinder container 222 containing buoyant gas. An actuation lever 224 is pivotally mounted to the housing 220 and when raised as shown in FIG. 16*d*, the lever 224 (by way of an internal plunger which is not shown) punctures the cylinder 222 (at its top end 223) which releases the buoyant gas towards the bottom body portion 218 via a passage element 226 positioned between body portions 216 and 218 and in fluid communication therewith. The body portion 218 comprises a pouch 228 for containing an inflatable member 230 such as a balloon which receives the buoyant gas (since it is in fluid communication with passage element 226) causing the inflatable member 230 to inflate as it exits the pouch 228 via an opening 233 thereof.

Figure 17:
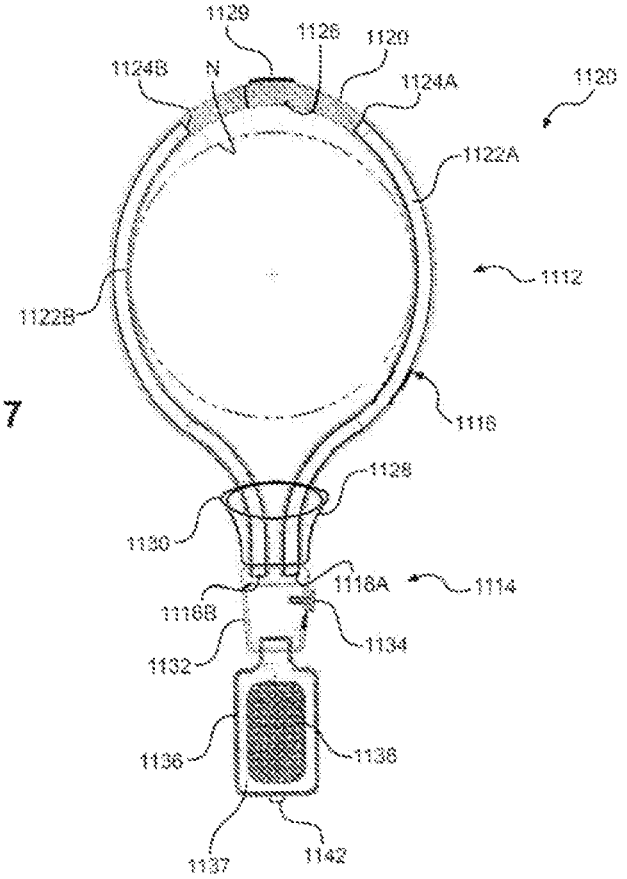
FIG. 17 is a front view of the inflatable neckwear flotation device in accordance with a non-restrictive illustrative embodiment to the disclosure.
Figure 18:
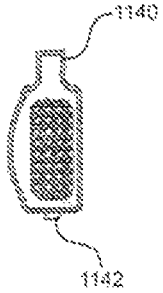
FIG. 18 is a lateral side view of the actuator bulb of the device shown in FIG. 17.

FIG. 17 shows the inflatable neckwear flotation device 1110 in accordance with an illustrative embodiment of the present disclosure. The device 1110 includes a top necklace portion 1112 as well as bottom controller portion 1114.

The necklace portion 1112 comprises a tubular member 1116 in the general form of a circle defining a pair of adjacent ends 1118A and 118B. The tubular member 16 comprises an outer sleeve 1120 and includes a pair of opposite inner bladders 1122A and 1122B. Bladder 1122A includes a pair of opposite ends 1118A and 1124A whereas bladder 122B includes opposite ends 1118B and 1124B. Tubular member 16 defines an internal opening 1126 providing a space for the neck circum N.

In one embodiment, a tracking element 1129 can be mounted to the tubular member 116.

The controller portion 1114 includes a cinch block 1128 for receiving the ends 1118B and 1118A of the tubular member 1116 therethrough. The cinch block 1128 also defines a top rim 130 which acts as a chin support area. The ends 1118A and 1118B are in fluid communication with an expansion chamber manifold 1132. The expansion chamber manifold 1132 includes a needle release valve 1134 and is connected to an actuator bulb 1136. The actuator bulb 1136 houses a pellet sack 1138 and includes a top connecting end 1140 fitted into the expansion chamber manifold 1132 and a bottom check valve intake 11142.

Figure 20:
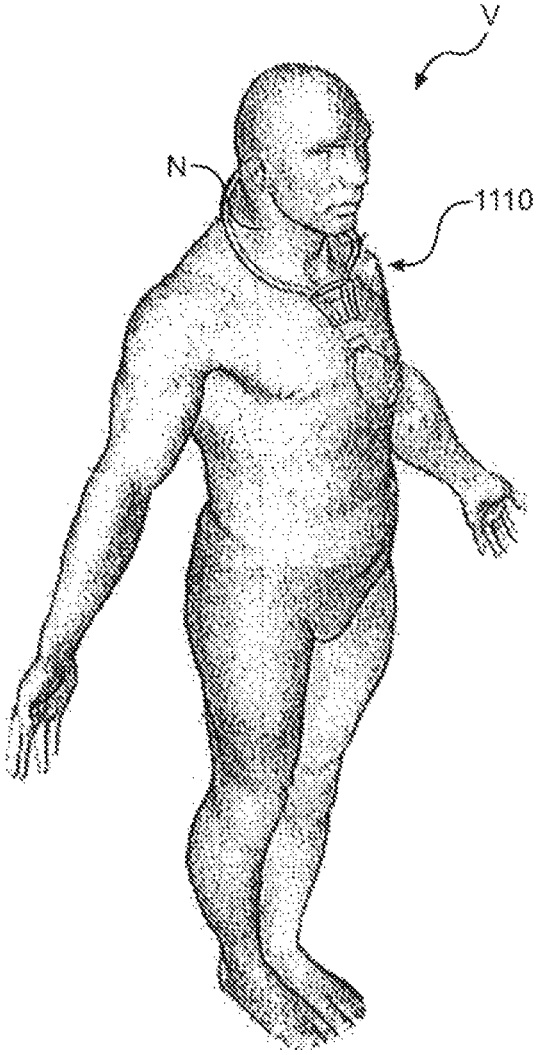
FIG. 20 is a top perspective view of the device of FIG. 17 mounted to a user.

As shown in FIG. 20, the device 1110 is placed around the neck N of a user U.

Figure 19:
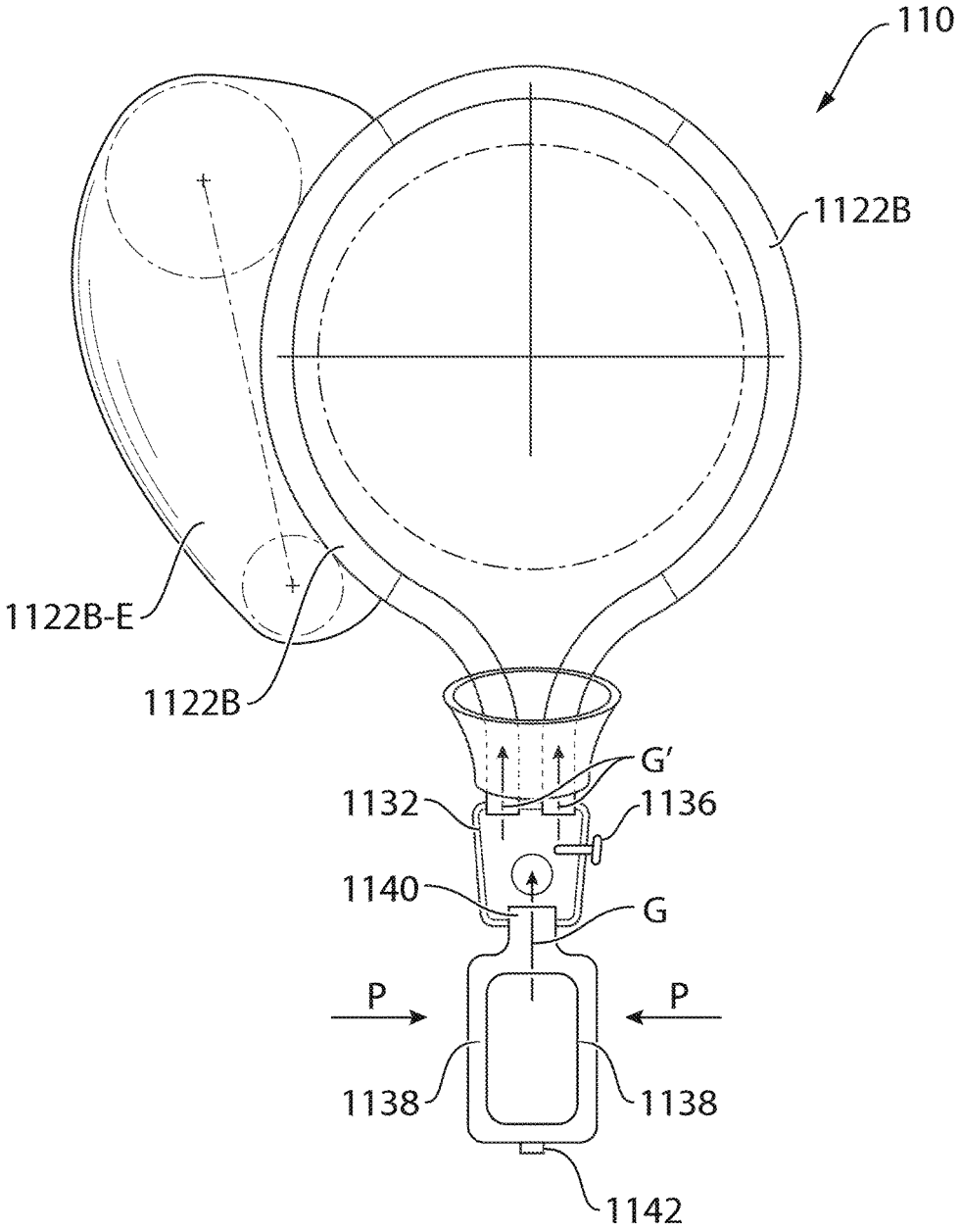
FIG. 19 is a front view of the device of FIG. 17 having a portion thereof being inflated.
Figure 21:
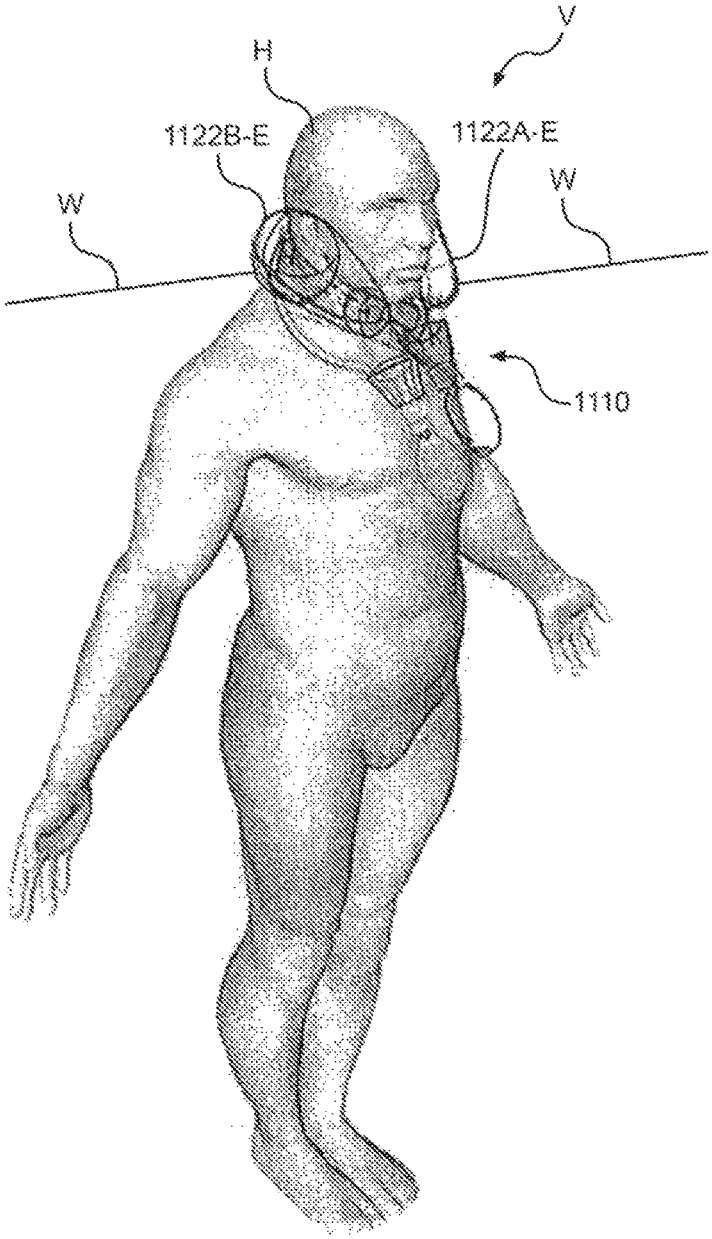
FIG. 21 is a top perspective view of the device of FIG. 20 when in an inflated position.

In operation and with particular reference to FIGS. 19 and 21, when the user U is in need of floating assistance in a dangerous situation whether in a pool, lake or ocean water, the actuator bulb 1136 which is, in essence, a hand pump, is squeezed by applying pressure thereon as shown by arrows P in FIG. 19, this breaks the pellet bag 1138 and namely the capsules within the pellet bag 1138 producing gas which moves up from bulb 1136 through the connector 1140, as shown by arrow g, into the expandable chamber manifold 132 and through there into each bladder 1122A and 1122B as shown by arrows g'. As discussed, the substance flows into the bladders 1122A and 1122B. Each bladder is expanded providing the configuration shown by expanded bladder 1122B-E in FIG. 19.

As shown in FIG. 21, when both bladders are expanded producing expanded flotations 1122B-E and 1122A-E, they engage the head H of the user maintaining the head of the user W.

If the user requires further air, the check intake valve 1142 can be used to suck in extra air as the bulb 1136 is pumped by being successively squeezed. Once the user is in a safe terrain, the bladders 1122A and 1122B can be deflated by releasing the needle value 36.

The tracking device 1129 can also allow a lifeguard, by way of an infrared detector or GPS detector, to more easily locate the user U for example.

The pellet bag 1138 may contain a variety of capsules. In one embodiment, the pellet bag contains hydrogen peroxide, with the bulb 136 containing water in which the pellet bag 1138 is placed. In another embodiment, the pellet bag contains dry capsules such as hydrogen peroxide as well as water capsules with or without the bulb containing water in area 1137 (see FIG. 7).

In another embodiment, an anti-freezing substance can also be placed within the pellet bag 138 or the bulb 1136.

It should be noted that the various components and features described above can be combined in a variety of ways so as to provide other non-illustrated embodiments within the scope of the disclosure. It is to be understood that the disclosure is not limited in its application to the details of construction and parts illustrated in the accompanying drawings and described hereinabove. The disclosure is capable of other embodiments and of being practiced in various ways. It is also to be understood that the phraseology or terminology used herein is for the purpose of description and not limitation. Hence, although the present disclosure has been described hereinabove by way of embodiments thereof, it can be modified, without departing from the spirit, scope and nature of the subject disclosure.

What is claimed is:

1. A wrist-wear personal flotation device for a user comprising:

a wristband to be worn to by the user;

a pouch mounted to the wristband containing an inflatable member and comprising an openable closure for enclosing the inflatable member therein;

a housing for a removable container containing buoyant gas, the housing being removably mounted to the wristband and to the pouch, and defining opposite longitudinal ends thereof;

a pipe extending from the housing to the inflatable member via the pouch; and an actuation lever mounted to one of the longitudinal ends of the housing, wherein movement of the actuation lever away from the housing provides for releasing the buoyant gas from the container into the inflatable member via the pipe causing the inflatable member to inflate and move outwardly of the container via opening of the closure thereby providing buoyancy to the user.

2. A personal flotation device according to claim 1, wherein the actuation lever provides for piercing the container containing buoyant gas for releasing the buoyant gas therein into the inflatable member.

3. A personal flotation device according to claim 1, wherein the actuation assembly comprises an actuation lever pivotally mounted to the housing in operative communication with a plunger for actuating the plunger to pierce the container containing buoyant gas.

4. A personal flotation device according to claim 1, wherein the inflatable member comprises a balloon.

5. A personal flotation device according to claim 1, further comprising an additional device selected from the group consisting of a GPS, a communication device, a thermometer, a watch, a compass, and any combination thereof.

6. A personal flotation device according to claim 1, wherein the buoyant gas comprises CO2.

7. A personal flotation device according to claim 1, wherein the housing comprises a cylindrical configuration and the container comprises a cylindrical configuration, the cylindrical container being removable by removing a cap of the housing threadably mounted to the housing at another one of the longitudinal ends.

8. A personal flotation device according to claim 7, wherein the housing comprises a base portion thereof inserted in a corresponding cavity formed by the pouch, the wristband being positioned through an opening in the base portion and through the corresponding cavity.

9. A personal flotation device according to claim 1, wherein the housing comprises the pipe, the pipe being inserted in a complementary aperture formed in a lateral wall of the pouch providing fluid communication with the inflatable member.

10. A personal flotation device according to claim 9, wherein the inflatable member comprises a pipe element connected to the pipe and via the complementary aperture and being clamped in place.

11. A personal flotation device according to claim 1, wherein the housing is positioned at one lateral side of the pouch and the closure opens at the other lateral side of the pouch.

* * * * *